United States Patent [19]

Schmidt

[11] 4,118,011

[45] Oct. 3, 1978

[54] LIFT MECHANISM WITH PLATFORM LOCKING DEVICE

[76] Inventor: Henning Falck Schmidt, Rasmus Rask Alle 37, DK-5000 Odense, Denmark

[21] Appl. No.: 784,860

[22] Filed: Apr. 5, 1977

[30] Foreign Application Priority Data

Apr. 5, 1976 [DK] Denmark ..... 1618/76
Oct. 19, 1976 [DK] Denmark ..... 4697/76

[51] Int. Cl.[2] ..... B66F 17/00
[52] U.S. Cl. ..... 254/124
[58] Field of Search ..... 254/2 C, 3 C, 4 C, 5 C, 254/6 C, 7 C, 8 C, 9 C, 10 C, 124; 108/1; 312/266; 214/763, DIG. 10; 74/527, 532

[56] References Cited

U.S. PATENT DOCUMENTS 2,521,214 9/1950 Goeller ..... 254/7 C

FOREIGN PATENT DOCUMENTS 510,374 1/1955 Italy ..... 254/8 C

*Primary Examiner*—Robert C. Watson
*Attorney, Agent, or Firm*—Holman & Stern

[57] ABSTRACT

A lift mechanism comprising a base, a lift arm pivoted to the base and a platform pivoted to the lifting arm includes a locking device operating between the lift arm and the platform to releasably lock these two components together if the platform deviates from a horizontal position thereby presenting further movement of the platform from the horizontal.

3 Claims, 2 Drawing Figures

LIFT MECHANISM WITH PLATFORM LOCKING DEVICE

BACKGROUND OF THE INVENTION

The present invention relates to a lift mechanism comprising a frame to which one end of a lift arm is pivoted on a horizontal shaft, and a platform pivoted at the other end of the lift arm on another horizontal shaft, the mechanism being controlled by an operating mechanism, which retains the platform substantially horizontal in irrespective to the position of the lift arm.

For maintaining horizontality of the platform, known lifts generally have a mechanically controlled mechanism e.g., a pantograph with steering links between the platform and the frame, or a hydraulic mechanism in which a double-acting cylinder between frame and lift arm is connected via two linkages to another double-acting cylinder between the lift arm and platform, or an electrically controlled mechanism in which a motor fixed to the lift arm may pivot the platform in relation to the lift arm controlled by a position-registering member associated with the platform.

An object of the invention is to provide a lift mechanism of the described type with a safety catch whereby the platform is retained in a substantially horizontal relation even if the control mechanism fails.

Such safety catch must be independent of hydraulic or electric systems.

BRIEF SUMMARY OF THE INVENTION

According to the invention the platform and the lift arm are provided with interacting locking devices, of which one is pivoted freely on a horizontal shaft, whereas the other one is firmly connected with the platform or the lift arm at such a distance from the former locking member that the two members are brought into mutual locking engagement when the platform is moved from its horizontal position.

The freely pivotable locking member may consist of a pawl suspended on a horizontal shaft, which is firmly connected with the platform and which in the horizontal position of the latter is situated vertically above a pivot shaft of the platform, whereas the other locking member firmly connected with the lift arm is at least a segment of an internally toothed gear rim co-axial with the pawl mounting shaft, whereby when the platform is horizontal, the pawl is brought into engagement with the gear teeth when, the platform moves away from the horizontal position and the pawl-mounting shaft moves away from the position vertically over the rotation shaft of the platform.

The locking member could alternatively consist of a ratchet wheel or two oppositely-directed ratchet wheels and an associated pawl or pawls, arranged so that a ratchet arm is brought in to engagement with the matching ratchet wheel when, caused by the movement of the platform away from the horizontal position, a ratchet-mounting shaft is moved away from a position vertically above the pivotal shaft of the platform.

As long as the control mechanism is working properly, i.e., as long as the platform remains horizontal, the pawl or pawls will hang freely. If on the other hand the platform, due to a control failure, is moved out of the horizontal plane, the pawl mounting shaft will be shifted sideways, and the pawl will engage the toothing of the appertaining gear rim or ratchet wheel. In this manner the platform will be locked in relation to the lift arm.

BRIEF DESCRIPTION OF THE DRAWINGS

The invention is explained in detail below in relation to the drawing, in which.

Figure 1:
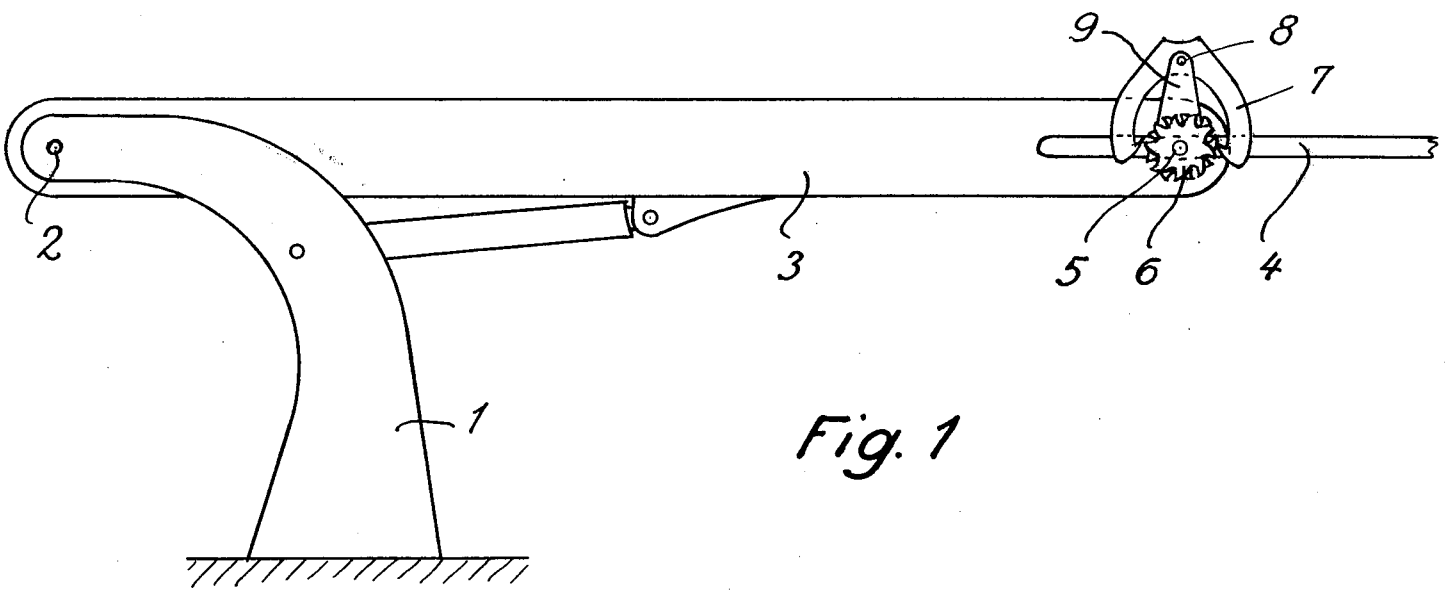
FIG. 1 is a schematic side view of a lift mechanism with a working platform and a safety catch according to the invention.

The lift depicted in FIG. 1 comprises a frame 1, which could be mounted on a carriage chassis, and a lift arm 3, which can pivot around a horizontal shaft 2 in relation to the frame 1, and further a working platform 4, which can pivot on a horizontal shaft 5 in relation to the lift arm controlled by a mechanism not shown, which keeps the platform in the shown horizontal position, irrespective of the inclination of the lift arm.

On the shaft 5 of the platform are mounted two ratchet wheels 6. These ratchet wheels with oppositely-directed teeth are firmly anchored to the lift arm 3 and accordingly turn with the latter around the shaft 5. Fixed to the platform 4 are one or more arms 9 carrying a shaft 8. This shaft 8 is parallel with the rotation shaft 5 of the platform, and when the platform 4 is horizontal, the shaft 8 is situated vertically above the shaft 5, as shown in the drawing. On the shaft 8 is suspended a freely pivotable twin pawl 7. The hanging arms of the pawl are situated on each side of the axis of the ratchet wheels, and the arms are axially disposed in such a manner that they can each be brought to engage one of the ratchet wheels, when the twin pawl is swung to one of the sides about the shaft 8.

As long as the platform 4 remains in the shown horizontal position the arms of the twin pawl 7 will hang freely without engaging the ratchet wheels 6. In case the platform control fails, and the platform moves out of the horizontal plane, for example downwards, the ratchet 8 will, relative to the rotation shaft 5, be shifted towards the right in the drawing. As the twin pawl 7 is allowed to swing freely — affected by gravitation — round the shaft 8, the left arm of the pawl will engage the one ratchet wheel 6 and thus prevent the platform 4 being turned additionally round the shaft 5 in relation to the lift arm 3. If the platform 4 is moved the opposite way, the shaft 8 will be displaced towards the left, and the right arm of the pawl will engage the other ratchet wheel 6.

With the above described construction, the platform and lift arm may mutually move arbitrarily around the shaft 5, as long as the platform remains horizontal. As soon as the platform 4 moves from the horizontal plane, one of the arms of the pawl 7 will engage a ratchet wheel and prevent an additional turning of the platform in relation to the lifter.

If the platform can only move in one direction when the control mechanism fails, one of the pawl 7 and one ratchet wheel can be omitted.

Figure 2:
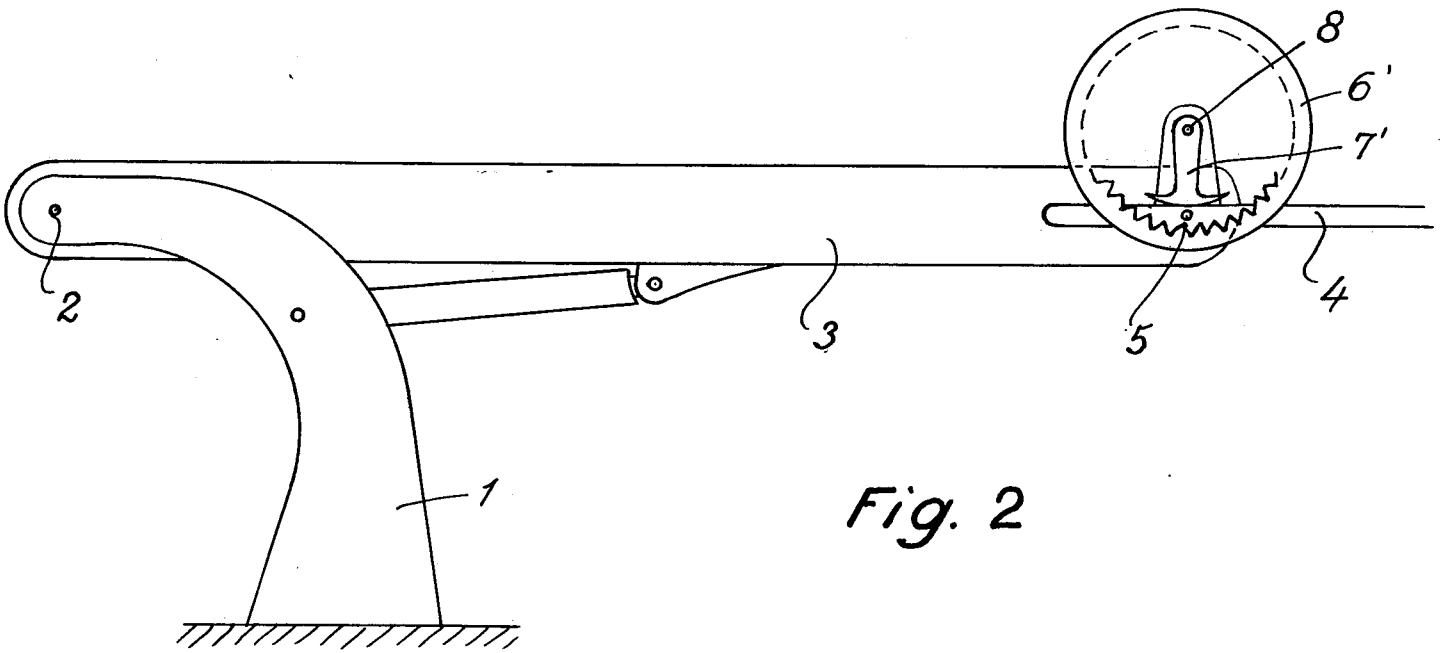
FIG. 2 is a schematic side view of another embodiment of lift mechanism.

In the embodiment shown in FIG. 2, a freely pivotable twin pawl $7^1$ is suspended on the shaft 8 attached to the platform 4. The twin pawl is encircled by an internally toothed gear rim $6^1$ fixed to the lift arm, the rim being co-axial with the pawl shaft $8^1$ when the platform is horizontal.

As long as the platform 4 remains in the shown horizontal position the twin ratchet $7^1$ will hang freely without engaging the gear rim 6. If, however, the control fails, and the platform moves out of the horizontal plane, for instance downwards, the shaft 8 will in relation to the rotation shaft 5 be displaced towards the right of the drawing. As the twin pawl $7^1$ can swing freely — affected by gravitation — around the shaft $8^1$, the pawl shown at the right of the drawing engages the gear rim and thus prevents the platform 4 turning further round the shaft 5 relative to the lift arm 3. If the platform 4 is moved the opposite way, the shaft 8 will be shifted towards the left, and the pawl shown at the left of the drawing will engage the gear rim $6^1$.

By the shown construction the platform and lift arm can be moved arbitrarily mutually around the shaft 5, as long as the platform remains horizontal. As soon as the platform 4 leaves the horizontal plane one of the pawls will engage the gear rim and prevent any additional turning of the platform relative to the lift arm.

If the platform can only move in one direction when the compulsorily controlled mechanism fails, one pawl and a portion of the ratchet wheel can be omitted.

I claim:

1. A lift mechanism comprising a lift arm, a platform pivoted to the lift arm whereby horizontality of said platform can be maintained irrespective of the position of said lift arm and a locking mechanism operative between said lift arm and said platform, said locking mechanism comprising first and second cooperative locking devices carried by the lift arm and the platform respectively, one of said locking devices including a freely pivoted member and the other of said locking devices including a fixed locking member complimentary to said pivoted member, said pivoted member being free from engagement with said fixed locking member when said platform is horizontal and being adapted to swinging into releasable locking engagement with said fixed locking member when said platform moves from a horizontal position to prevent further movement of said platform from the horizontal position.

2. A lift mechanism according to claim 1 wherein the freely pivoted locking member consists of a twin pawl pivoted on a horizontal shaft connected with the platform and which when the platform is horizontal is situated vertically above a further shaft by which the platform is pivoted to the lift arm and wherein the other locking member is fixed to the lift arm and consists of at least a segment of an internally tooth gear rim coaxial with the horizontal shaft when the platform is horizontal, the pawl and gear rim being positioned whereby the pawl is brought to engage the gear teeth when the platform moves away from the horizontal position and the horizontal shaft moves away from said position vertically over said further shaft.

3. A lift mechanism according to claim 1 wherein the freely pivotal locking member consists of at least one pawl suspended on a horizontal shaft connected with the platform and which in the horizontal position of the platform is situated vertically above a further shaft by which the platform is pivoted to the lift arm and wherein the other locking member is fixed to the lift arm and consists of at least one ratchet wheel whereby said at least one pawl is brought to engage the ratchet wheel when the platform moves away from the horizontal position and the horizontal shaft is moved away from the position vertically above said further shaft.

* * * * *